US010470965B2

(12) United States Patent
Vallery et al.

(10) Patent No.: US 10,470,965 B2
(45) **Date of Patent: *Nov. 12, 2019**

(54) APPARATUS FOR UNLOADING A USER'S BODY WEIGHT DURING A PHYSICAL ACTIVITY OF SAID USER, PARTICULARLY FOR GAIT TRAINING OF SAID USER

(71) Applicants: LUTZ MEDICAL ENGINEERING, Rudlingen (CH); ETH ZURICH, Zurich (CH); UNIVERSITAT ZURICH, Zurich (CH)

(72) Inventors: Heike Vallery, Dorsten (DE); Peter Lutz, Rudlingen (CH)

(73) Assignees: LUTZ MEDICAL ENGINEERING, Zurich (CH); ETH ZURICH, Zurich (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/796,814

(22) Filed: Oct. 29, 2017

(65) Prior Publication Data

US 2018/0055715 A1 Mar. 1, 2018

Related U.S. Application Data

(63) Continuation of application No. 14/377,507, filed as application No. PCT/EP2013/052623 on Feb. 9, 2013, now Pat. No. 9,801,775.

(30) Foreign Application Priority Data

Feb. 9, 2012 (EP) ..... 12154778

(51) Int. Cl.

| | |
|---|---|
| ***A61H 3/00*** | (2006.01) |
| ***A61G 7/10*** | (2006.01) |
| ***A63B 21/00*** | (2006.01) |

(52) U.S. Cl.
CPC ..... *A61H 3/008* (2013.01); *A61G 7/1042* (2013.01); *A61G 7/1061* (2013.01);
(Continued)

(58) Field of Classification Search
CPC .. A61G 7/1042; A61G 7/1061; A61G 7/1051; A61H 3/008; A61H 2203/0481;
(Continued)

(56) References Cited

U.S. PATENT DOCUMENTS 219,439 A * 9/1879 Blend ..... A63B 22/001 482/69
3,628,505 A * 12/1971 Myers ..... A01K 39/0125 119/57.4

(Continued)

FOREIGN PATENT DOCUMENTS

WO 2006/017926 2/2006
WO 2011/079115 6/2011

*Primary Examiner* — Megan Anderson
(74) *Attorney, Agent, or Firm* — JMB Davis Ben-David

(57) ABSTRACT

The invention relates to an apparatus and method for unloading a user's body weight during a physical activity of said user, particularly for gait training of said user, comprising: a plurality of ropes, wherein each rope extends from an associated drive unit, is deflected by a passively displaceable deflection device, e.g. a device that is displaceable by means of the forces in the deflected ropes, and then runs to a first free end of the respective rope, and a node being coupled to said first free ends and being designed to be coupled to said user, wherein the drive units are designed to retract and release the respective rope so as to adjust a current rope force along the respective rope, which current rope forces add up to a current resulting force exerted on said user via said node in order to unload the user upon said physical activity.

16 Claims, 5 Drawing Sheets

(52) U.S. Cl.
CPC ..... *A63B 21/4009* (2015.10); *A61G 7/1051* (2013.01); *A61H 2201/165* (2013.01); *A61H 2201/1652* (2013.01); *A61H 2201/50* (2013.01); *A61H 2201/5061* (2013.01); *A61H 2203/0406* (2013.01); *A61H 2203/0481* (2013.01)

(58) Field of Classification Search
CPC .... A61H 2203/0406; A61H 2201/5061; A61H 2201/50; A61H 2201/1652; A61H 2201/165; A63B 21/4009
See application file for complete search history.

(56) References Cited

U.S. PATENT DOCUMENTS

| | | | | | |
|---|---|---|---|---|---|
| 3,780,663 | A | * | 12/1973 | Pettit | A61G 7/1015 104/307 |
| 4,887,325 | A | * | 12/1989 | Tesch | A61G 7/1015 24/134 KB |
| 4,944,056 | A | * | 7/1990 | Schroeder | A61G 7/1015 5/85.1 |
| 5,601,527 | A | | 2/1997 | Selkowitz | |
| 5,603,677 | A | * | 2/1997 | Sollo | A61H 1/0229 135/67 |
| 6,146,315 | A | * | 11/2000 | Schonenberger | A63B 22/02 482/54 |
| 8,920,347 | B2 | * | 12/2014 | Bayerlein | A63B 22/0235 601/35 |
| 9,682,000 | B2 | * | 6/2017 | Behnke | A61G 7/1001 |
| 2012/0018249 | A1 | | 1/2012 | Mehr | |

* cited by examiner

APPARATUS FOR UNLOADING A USER'S BODY WEIGHT DURING A PHYSICAL ACTIVITY OF SAID USER, PARTICULARLY FOR GAIT TRAINING OF SAID USER

CROSS REFERENCE TO RELATED APPLICATIONS

This is a continuation of U.S. patent application Ser. No. 14/377,507, filed Aug. 8, 2014, which is the US National Stage of International Application No. PCT/EP2013/052623, filed Feb. 9, 2013, which in turn claims the benefit of European Patent Application No. 12154778.0, filed Feb. 9, 2012. The content of the foregoing patent applications is incorporated by reference herein in its entirety.

FIELD

The invention relates to an apparatus, particularly for (e.g. guidedly) unloading a user's body weight during a physical activity of said user, particularly for gait training of said user (e.g. patient). Of course, also animals, robots or any other object may be unloaded by the apparatus according to the invention. Thus, the term "user" may specifically refer to a human person, but may also mean any other object that is to unload.

BACKGROUND

Typically, in known devices of this kind, a user is statically suspended from a lift line while walking on a treadmill. Thus, the sort of physical activities (trainings) that can be performed by the user are rather limited.

Based on the above, the problem underlying the present invention therefore is to provide for an apparatus that allows for a variety of different physical activities or movements while safely supporting the user (object) at the same time in a defined manner.

SUMMARY

This problem is solved by a device having the features of claim 1 as well as by a method having the features of claim 15.

Preferred embodiments are stated in the respective sub claims and are described below.

BRIEF DESCRIPTION OF THE DRAWINGS

Further features and advantages of the invention shall be described by means of a detailed description of embodiments with reference to the Figures, wherein.

DETAILED DESCRIPTION

Figure 1:
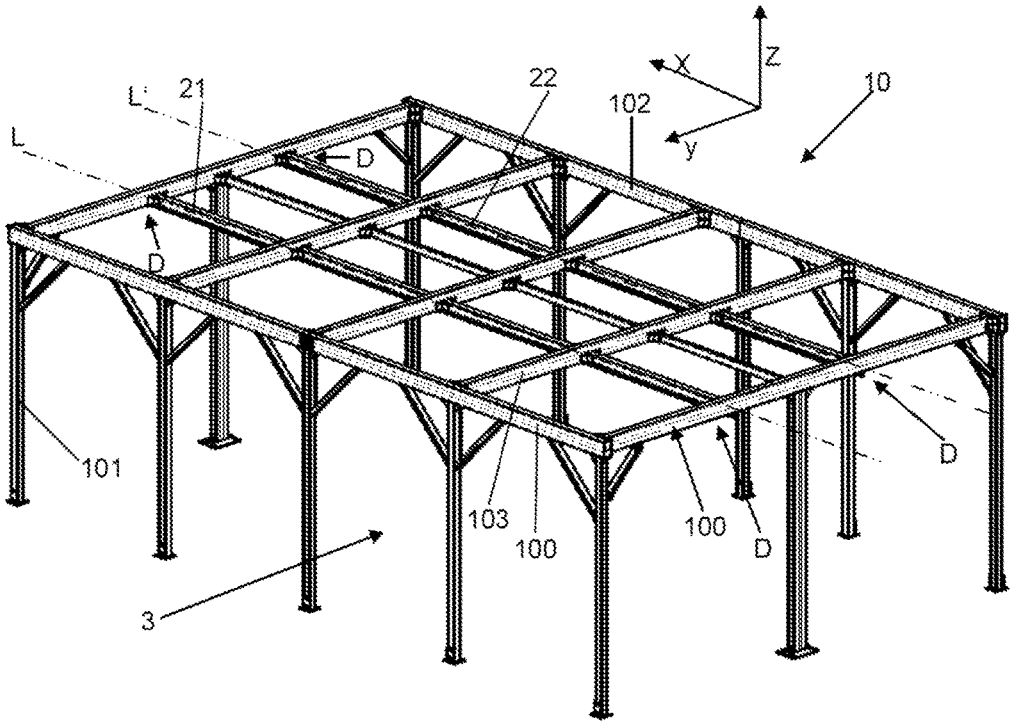
FIG. 1 shows an exemplary support frame of an apparatus according to the invention.

According thereto, the apparatus according to the invention comprises a plurality of ropes, wherein each rope is coupled to an associated drive unit being particularly connected to a suitable rigid support structure (for example a support frame or a ceiling) and extends from the respective drive unit to a (uniquely associated) deflection device for deflecting the respective rope and then to a first free end of the respective rope, and a node being coupled to said first free ends and being designed to be coupled to said user, wherein the drive units are designed to retract and release (e.g. wind and unwind) the respective rope so as to generate a current rope force along the respective rope, which current rope forces add to a current resulting force exerted on said user via said node in order to continuously unload the user upon said physical activity. Particularly, the node can also be an extended body, e.g. a frame for instance. Particularly, the ropes must not necessarily meet in one point.

Preferably, the deflection devices are passively displaceable (i.e. can change their position in space, particularly in a guided manner), which particularly means that they do not themselves comprise a movement generating means for moving the respective deflection device actively, but can be displaced by forces induced into the deflection devices via the ropes. Particularly, the deflection devices may be connected to each other (for instance pairwise such that the respective two deflection devices can be displaced together while maintaining a constant distance between the deflections devices along the direction of displacement), and they may be guided by a guide rail or a plurality of guide rails or may be suspended from a support structure (e.g. support frame or ceiling of a room), particularly by means of a wire or another (elongated) supporting element such that their centers of mass can (passively) change position in space. Likewise, said guide rail(s) may be connected to a support structure (e.g. support frame or ceiling). A connection between two (or even more) deflection elements can be provided by means of an (e.g. separate) connecting means (element), which may be interchangeable. However, deflection devices may also be integrally connected to each other (i.e. form a single piece).

The rope forces may be controlled such that the resulting rope force is a purely vertically acting force, but may also have components in the horizontal plane so as to direct the user in a certain direction upon said physical activity (e.g. gait training). Further, not only forces can be controlled, also the position of the node. This can be used for transportation of loads (alternative application), or just to position the device above a user.

Preferably, the apparatus according to the invention is configured such that a user (or object) coupled to the node as intended can in principle perform a movement in a three dimensional space, i.e., is able to move horizontally, namely forwards backwards and also sideways, as well as vertically (e.g. climbing a staircase or some other object such as an inclined surface provided in the horizontally extending space accessible to the user being coupled to the node), and can rotate about the vertical axis, allowing walking curves or turning. Of course, the apparatus according to the invention can also be combined with known devices such as a treadmill etc.

However, in an embodiment of the invention, the deflection devices may be fixed such that they are not moving in space or along the guide rails. Particularly, the deflection devices are designed to be fixed in a releasable manner to the guide rails so that the deflection units are temporarily lockable regarding their movement along the guide rails, According to a further embodiment of the invention, the support frame comprises an upper frame part extending along a horizontal extension plane, wherein the support frame may comprise a plurality of vertically extending leg members via which the upper frame part can be supported on a floor.

According to a further aspect of the invention, the apparatus according to the invention comprises force sensors designed to directly or indirectly measure forces in the ropes or directly on the user. Particularly, each of the ropes interacts with an associated rope force sensor for determining the currently acting rope forces and thereby the current resulting force on the user. Alternatively, the current rope forces may be detected by means of electrical current sensors interacting with the drive units (for instance such sensors may be integrated into the actuators of the winches).

Preferably, these rope force sensors provide (e,g, analog or digital) output signals corresponding to the currently acting rope forces (current rope forces).

In an embodiment of the invention, said output signals are transmitted via a processing means which digitizes said output signals to a controlling unit (also denoted as control unit) that is able to determine the currently acting rope forces by means of said output signals provided by the rope force sensors.

According to an aspect of the invention, the controlling unit is designed to control said current resulting force (on the node/user) or the position of the node either directly via said drive units or indirectly by controlling said rope forces (i.e., the individual rope forces acting on the node) in an (inner) control loop in order to adjust said current resulting force for unloading (and eventually also pulling) the user in a predefined manner, wherein the controlling unit is preferably designed to calculate a currently desired (reference) rope force for each of the ropes and to control the drive units accordingly such that the current rope forces as determined with help of the respective rope force sensor (or another sensor) match (approach) the respectively desired rope force at least asymptotically after a certain period of time. Of course controlling is preferably conducted continuously, wherein particularly the desired rope forces (or desired resulting force) and current rope forces (or current resulting force) may be repeatedly calculated/sensed (e.g. at a constant rate). In both cases (e.g. indirect or direct control of the resulting rope force vector), the controlling unit may be designed to control not only the resulting rope force, but also to influence the movement of the passively displaceable deflection units in a desired way at the same time. For example, in the case of four winches, the mapping from a three-dimensional resultant rope force correction to four individual winch force corrections is not unique. It represents an underdetermined system of equations. This results in freedom to influence the dynamics of the displaceable deflection units as well. For example, it can be desirable to enforce certain relative dynamics of the deflection units. In the case of two deflection units, enforcing a certain desired (for example asymptotically stable) relative displacement of the two deflection units (also denoted as trolleys) with respect to each other delivers the missing additional constraint in the equation system.

Alternatively (or in addition), the controlling unit may be designed to control the drive units such that the current (spatial) position of the node (e.g. with respect to a space-fixed coordinate system or with respect to said apparatus) approaches a (currently) desired position of the node.

In an embodiment of the invention, the apparatus comprises at least two ropes, preferably four ropes, namely a first, a second, a third and a fourth rope (preferably, but not necessarily, there is an even number of ropes). Preferably, the first rope extends from its associated drive unit towards a first deflection device, is deflected by the first deflection device and then connects to the node. Likewise, the second rope preferably extends from its associated drive unit towards a second deflection device, is deflected by the second deflection device and then connects to the node. Further, also the third rope (if present) preferably extends from its associated drive unit towards a third deflection device, is deflected by the third deflection device and then connects to the node. Finally, also the fourth rope (if present) extends from its associated drive unit towards a fourth deflection device, is deflected by the fourth deflection device and then connects to the node. Preferably, two or more deflection devices are connected to each other to form a deflection unit, so that their combined movement is governed by (multiple) rope forces acting on them.

In an aspect of the invention, each rope may be connected to the node via a spring element.

Particularly, the rope force sensors may be formed with help of such spring elements (being inserted into the respective rope) in combination with a means to measure the length of the respective spring element, e.g. a linear encoder or a wire sensor, which may be a cable-extension transducer comprising a measuring cable wound on a cylinder (spool) coupled to a shaft of a rotational sensor (e.g. a potentiometer), wherein the respective rotational sensor is connected to an end of the respective spring element and wherein the respective measuring cable is connected to another end of the respective spring element. In case the transducer's measuring cable is now unreeled or reeled from the cylinder when the respective spring element is elongated or contracted, the cylinder and shaft rotate accordingly, thus creating an (electrical) output signal of the rotational sensor proportional to the measuring cable's linear extension. Knowing the spring constant of the respective spring element, the rope force can thus be determined via the spring force of the respective spring element. In this regard, it is to be noted that any other force sensor may also be employed in order to measure the individual rope forces acting on the ropes and/or directly the resultant rope force acting on the user. It is also possible to employ sensors that measure the angles of the ropes in space, and thereby the direction of forces (e.g. by angle sensors or by inertial measurement units), or sensors that measure the forces acting between connected deflection devices of at a deflection unit, and thereby indirectly the rope forces or components thereof.

Preferably, the force sensor is located close to the node, but it can also be located closer to the respective drive unit or winch, or even be based on measurement of the electrical current of the respective drive unit (e.g. actuator driving the respective winch).

According to an aspect of the invention, the apparatus comprises at least a first guide rail (for instance in case of two ropes and two deflection devices), preferably also a second guide rail, each running along a longitudinal axis. These longitudinal axes preferably extend horizontally with respect to an operating position of the apparatus, in which the apparatus can be operated (e.g. by the user) as intended. Preferably, the guide rail(s) can be connected to said support structure (e.g. support frame or ceiling of a room, in which the apparatus is arranged). In case of a support frame, the guide rail(s) may be connected to said upper frame part. Preferably, the guide rails are arranged such that they run parallel with respect to each other. Particularly, in case of two guide rails, each guide rail may be tilted about its longitudinal axis, particularly by an angle of 45°.

Preferably, the first and the second deflection device are slidably connected to the first guide rail, so that they can slide along the first guide rail along the longitudinal axis of the first guide rail. In case of four ropes, the third and the fourth deflection device are preferably slidably connected to the second guide rail, so that they can slide along the second guide rail along the longitudinal axis of the second guide rail.

In detail, the individual deflection devices may comprise a base (e.g. in the form of a cart) via which the respective deflection device can be slidably connected to the associated guide rail, and wherein each deflection device particularly comprises an arm hinged to the base of the respective deflection device so that the respective arm can be pivoted with respect to the respective base about a pivoting axis running parallel to the longitudinal axis of the respective guide rail. Further, the deflection devices may each comprise a deflection element connected to the respective arm, around which deflection element the respective rope is laid for deflecting said rope, and wherein the respective deflection element may be formed by a roller that is rotatably supported on the respective arm, so that particularly the respective roller can be rotated about a rotation axis that runs across the longitudinal axis of the respective guide rail. Further, an arresting means may be provided for each deflection device for arresting the respective deflection device with respect to the associated guide rail, for instance when using the apparatus with a treadmill.

According to a further aspect of the invention, the first and second deflection device are connected by a connecting element (or by an integral connection), which is preferably elastic (particularly such that the restoring force is proportional to the elongation of the elastic connecting element) or non-elastic, so as to form a first deflection unit (also denoted as first trolley). Likewise, in case of four ropes, the third and the fourth deflection device are preferably connected by a further connecting element (or by an integral connection), which may also be elastic or non-elastic (see above), so as to form a second deflection unit (also denoted as second trolley), wherein particularly said connecting elements comprise the same length along the longitudinal axis of the respective guide rail. Further, the connecting elements may be designed to releasably connect the associated deflection devices, in order to be able to substitute a connecting element with a connecting element having a different length along the respective longitudinal axis. Further, the respective connecting element may be a flexible rope member or a rigid rod (particularly produced out of a carbon fibre composite).

Preferably, the drive unit of the first rope and the drive unit of the second rope face each other along the longitudinal axis of the first guide rail, wherein the first deflection unit is arranged between said drive units along the longitudinal axis of the first guide rail. In a similar manner, in case of four ropes, additionally also the drive unit of the third rope and the drive unit of the fourth rope face each other along the longitudinal axis of the second guide rail, wherein the second deflection unit is arranged between said drive units along the longitudinal axis of the second guide rail. Preferably, the drive units are arranged on the corners of a rectangle.

According to a further aspect of the invention, the drive units each comprise an actuator (particularly a servo motor) being connected to a winch, around which the respective rope is wound, particularly via a flexible coupling, wherein the respective actuator is designed to exert a torque on the respective winch via a drive axis of the respective winch so as to retract or release the respective rope, i.e. to adjust the length of the respective rope that is unwound from the winch. Optionally, the respective drive unit may comprise a brake for arresting the respective winch. Further, in order to prevent the respective rope from jumping off the associated winch or over a thread, the respective drive unit preferably comprises at least one pressing member, particularly in the form of a pressure roller that presses the respective rope being wound around the associated winch with a predefinable pressure against the winch.

According to a further aspect of the invention, the drive units may be coupled to an actuator unloading system that is designed to compensate for the weight that is to be unloaded so that the actuators do not have to permanently exert the full torque on the winches, but are merely needed to support changes in movement or a portion thereof.

According to yet another aspect of the invention, the apparatus comprises a sensor means for determining a current state of the apparatus as well as the position of the user (node) with respect to the apparatus or a space-fixed coordinate system. Particularly, said current state is given by the lengths of the ropes being unwound from the respective winch and the positions of the deflection units along the respective guide rail.

In detail, the lengths unwound from the winches (i.e. the length of the portion of the respective rope that is unwound from the respective winch) is preferably detected by multi turn encoders being coupled to the drive axes of the winches, respectively. Other sensors (e.g. cable-extension transducers may also be employed for determining said lengths).

Further, from output signals provided by said multi turn encoders, the position of the node can also be determined by means of the controlling unit. Furthermore, the positions of the deflection units along the respective guide rails may be each captured by means of distance sensors, for example linear encoders, magnetic transducers, or optical laser distance sensors, which distance sensors—in the case of laser sensors—may be arranged at a free end of each guide rail, and whose output signals may also be digitized by a signal processing unit and further transmitted to the controlling unit.

In case of elastic connecting elements between the deflection devices, the current rope forces can be calculated with help of the positions of the deflection devices (e.g. the apparatus is designed to calculate the current rope forces or directly force components on the node with help of the positions of the deflection devices). In this case force sensors at the node may be omitted.

Further, for determining the acceleration of the node, an acceleration sensor may be provided on the node, being capable of sensing the acceleration of the node along three orthogonal axes. The node may comprise an upper and a lower node member being rotatably connected to each other, wherein the ropes are connected to the upper node member and wherein a bail (see below) may be connected to the lower node member, such that the bail can be rotated about the vertical axis. For determining an angular velocity of the node (i.e. of the upper node member), a gyroscope may be provided on the node. For sensing orientation of the node (e.g. of the upper node member), a magnetometer may be provided on the node. Furthermore, for sensing a rotation angle of said bail about the vertical axis a potentiometer may be provided on the node that measures the angle between the upper and the lower member (part) of the node. The acceleration sensor, the gyroscope, the magnetometer, and the potentiometer may provide analog or digital output signals representing the respective quantity to be sensed, wherein particularly these sensors are preferably connected to a signal processing unit that is configured to digitize the respective output signals and/or to transmit them to the controlling unit, wherein said signal processing unit is preferably connected to the node by means of a flexible data line or a wireless connection. Further, the signal processing unit may also be arranged on the node. Preferably, the acceleration sensor, the gyroscope, and the magnetometer are integrated into an inertial measuring unit (IMU) arranged at the node, which IMU preferably provides digital output signals which are particularly forwarded by the signal processing unit. In the examples above the controlling unit may be designed to further process and/or analyze said (digitized) output signals provided by the individual sensors so as to determine the respective quantity, like the lengths of the ropes being unwound from the winches, the positions of the deflection units, or the position of the node (user).

Especially, the acceleration sensor, the gyroscope, the magnetometer and the potentiometer may be used to enhance measurement of the orientation of the resultant force as well as position detection of the user and the node.

According to a further preferred aspect of the invention, the controlling unit is designed to control the drive units, particularly the torque exerted by the respective actuator onto the respective winch, particularly depending on a current state of the apparatus and/or the spatial position of the user determined with help of the afore-described sensor means, such that the current resulting force on the user approaches (matches) the desired resulting force on the user or that the current position of the user (node) approaches (matches) a currently desired position (reference) of the user (node). In particular, the controlling unit can control this current resulting force either directly, i.e. by sending control signals to the drive units as a function of the error (e.g. difference) between a (currently) desired resulting force and the current resulting force, or indirectly, by controlling the current rope forces or winch positions (e.g. the lengths of the rope portions unwound from the winches) by means of a control loop denoted as inner control loop or inner loop.

To control the current resulting force directly, without such an inner loop, the controlling unit may be configured to apply a pre-defined torque to a plurality of the drive units at the same time as a function of said error in the current resulting force, in order to provide for a fast reaction in highly dynamical situations, for instance.

Thus, in one embodiment of the present invention, in case the walking direction of the user is pointing along the longitudinal axes of the guide rails for example, the controlling unit may be designed to perform a lateral correction on the user by commanding the respective drive units to pull the ropes of the first or the second deflection unit at the same time by the same amount. Likewise, the controlling unit may be designed to perform a forward or backward correction on the user by commanding the respective drive units to pull those two corresponding ropes at the same time by the same amount that oppose each other across the longitudinal axes of the guide rails.

In an alternative embodiment, said function can be defined like this: The winch forces $F_W$ or the corresponding torques $u=iF_w$ (with i denoting the geometric relation between winch force and winch torque, e.g. the winch radius, or the winch radius multiplied by a possible additional transmission ratio) exerted onto the winches are required to fulfill the equation:

$$JF_W=F_{des}+(K_P+K_I/s)(F_{des}-F),$$

(this equation holds for the torques up to the constant factor i), where the matrix J is the 3×4 Jacobian, which only depends on the current geometry (node position, deflection unit positions), F is the current force vector on the user, and $F_W$ is the vector of winch forces $F_W$. $K_P$ and $K_I$ are matrices containing proportional and integral gains, respectively, and s is the Laplace operator. As this is an underdetermined system of equations, there is still freedom of choice in the winch forces $F_W$. This can be solved by adding another equation that enforces desired movement of the deflection units, for example to achieve asymptotic attenuation of the relative displacement between the two deflection units. As the relative displacement is also a function of rope forces, the system of equations can be solved.

In case of said indirect controlling said inner loop (provided by the controlling unit) is particularly used to calculate the desired rope forces or winch positions being a reference for said inner loop by requiring a desired static equilibrium, where there is force equilibrium on the node, there is force equilibrium on the deflection units, and the deflection units both reside in the same position along the respective guide rail.

Particularly, the controlling unit (inner loop) is designed to control the drive units (e.g. the corresponding torques on the winches), such that the current winch positions or rope forces (which may be determined with help of the rope force sensors or positions of the deflection devices) each approach (match) the respective (currently) desired rope force or winch positions, respectively.

Further, in an embodiment of the invention, the controlling unit is configured to control the torques applied to the individual winches according to the following control law used by the controlling unit $$u=i(F_{R,des}+K_r(F_{R,des}-F_R))+u_{ff},$$

with $F_{R,des}\in\mathbb{R}^{n\times 1}$ being the calculated reference rope forces (for example calculated according to said indirect control), $i\in\mathbb{R}$ being the transmission ratio of the respective winch, $K_r\in\mathbb{R}^{n\times n}$ being a positive definite rope force feedback matrix containing feedback gains, $n\in\mathbb{N}$ being the number of ropes (e.g. four), and $u_{ff}\in\mathbb{R}^{n\times 1}$ being an optional additional term going to zero in static conditions of the apparatus by means of which a pre-defined torque can be applied to a plurality of the winches at the same time (for example calculated according to said direct control).

According to a further aspect of the invention, the controlling unit may also be configured to control said torques such that a current position of the node approaches a respective desired position of the node.

Further, the afore-mentioned bail particularly comprises two opposing free ends, wherein particularly each of the two free ends comprises a receptacle (for instance in the form of a hook formed by the bail) for receiving a connection element for connecting a harness to the bail, which harness is to be put on by the user for connecting the latter to the node (via the connection elements and the bail). In a variant of the invention the connection elements are designed to be length adjustable for adapting the apparatus to the height of a user, for instance.

The signal processing unit that may connect to the acceleration sensor, the gyroscope, the magnetometer and the potentiometer (see above) may also be connected to the rope force sensors provided on the node, preferably through a (flexible) data line (cable). The signal processing unit thereby transmits output signals provided from the rope force sensors to the controlling unit, where they can be further processed.

For enabling the signal processing unit to follow the node upon movement of the node, the signal processing unit is preferably slidably connected to one of the guide rails or directly to the node. The signal processing unit may be driven by a further drive unit, wherein particularly the controlling unit is designed to also control the position of the signal processing unit along the guide rail depending on the position of the deflection units (or the node) and the signal processing unit along the guide rail, so as to maintain a constant distance between the deflection units or node and the moveable signal processing unit along the respective guide rail. The respective position of the movable signal processing unit may be sensed with a suitable sensor and compared to the current position of the node by the controlling unit.

The problem according to the invention is further solved by a method for controlling an apparatus for unloading, particularly the body weight of a user during a physical activity, as claimed in claim 15, wherein the method particularly uses an apparatus according to the invention.

The method according to the invention may comprise the steps of:

particularly determining a current state of a system of a plurality of ropes each being connected to a node via a first free end of the respective rope, to which node a user (being enabled to displace the node horizontally and also vertically upon walking) or an object is coupled, which ropes can each be wound onto and unwound from a respective winch in order to adjust the rope forces acting along the respective ropes on the node, wherein the ropes are each deflected by a (uniquely) associated deflection device, which deflection devices are each (passively) movable (e.g. along a first direction) and particularly connected to each other, particularly as described above, particularly determining the position of the user (with respect to the apparatus or a space-fixed coordinate system), calculating a torque for each of the winches (or a corresponding winch force) depending on the current state of the apparatus and/or the position of the user, such that the force on the user approaches (matches) the respective desired force on the user, that the current position of the user (or node) approaches a (currently) desired position of the user (or node), and/or that the movable deflection devices (or units) approach desired movements, respectively, and exerting the respective torque onto the associated winches in order to let the current resulting force on the user (or node) approach the (currently) desired resulting force, to let the current position of the user (or node) approach a (currently) desired position of the user (or node), and/or to let the movable deflection devices (or units) approach certain desired movements, respectively.

Preferably, the deflection devices are grouped in pairs (or may comprise even more deflection devices), wherein the deflection devices of each pair are designed to be displaced together (i.e. maintaining a constant distance with respect to each other while being passively displaced), which pairs are denoted as deflection units. Particularly at least two ropes are provided that are deflected by a first deflection unit that may be displaceable as a function of the rope forces in the deflected ropes along a first direction (x-direction). Preferably, four ropes are provided, wherein the first and the second rope are deflected by the first deflection unit and the third and fourth rope are deflected by a second deflection unit being passively displaceable along the first direction (parallel to the first deflection unit).

Particularly, said current state is defined by the lengths of the ropes being unwound from the respective winch and the position(s) of the deflection unit(s) along the first direction.

Furthermore, the current torques for the winches are preferably calculated either directly based on the current error (e.g. difference) between a desired resulting force on the user and the current resulting force on the user, or indirectly, by controlling the individual rope forces or winch positions (e.g. lengths of the portions of the ropes being unwound from the respective winch) in a control loop denoted as inner control loop or inner loop (see also the corresponding description above). In the latter case, the desired rope force for each of the ropes is preferably determined from a desired static equilibrium, where there is force equilibrium on the node, there is force equilibrium on the deflection unit(s), and the deflection units both reside in the same position along the first direction (in case there are a two or more deflection units).

Here, the controlling unit is preferably designed to control the drive units (command torques to the drive units) such that the current rope forces approach the calculated desired rope forces.

In case of direct control of the force on the user, the method according to the invention may provide for applying a pre-defined torque to a plurality of the winches at the same time, particularly in order to let the current resulting force F on the user approach the desired resulting force $F_{des}$ on the user faster.

Particularly, in an embodiment of the present invention, the torques u (applied to the individual winches) may be determined according to $$u=iF_{R,des}+K_r(F_{R,des}-F_R)+u_{ff}$$

as already discussed above, where $F_{R,des}$ are the desired rope forces (references), $F_R$ are the current rope forces, $K_r$ is a matrix containing feedback gains and $u_{ff}$ is an optional additional term (being zero in static conditions of the apparatus) by means of which a pre-defined torque can be applied to a plurality of the winches at the same time, so as to achieve the control goal as fast as possible in dynamic situations (e.g. fast movements of the node/user).

According to a further embodiment, based on e.g. the current operation mode and e.g. current sensor information, the controlling unit may generally be designed to determine a desired force $F_{des}$ that should act on the user, or a desired position of the node. For example, the desired force could be a constant unloading force in vertical direction that is rendered as long as the user does not fall. When a fall is detected (based on current sensor information), the desired force is calculated such that it compliantly catches the user and stops the fall. In another example, the force could be a guiding force that helps the user follow a particular movement pattern (like a force that pulls the user forward in walking direction), or it could be a perturbing or resisting force that makes a motor task more difficult for the user. The desired force or position of the node can also be commanded by a human operator of the apparatus, e.g. by means of a software interface or a remote control unit.

In yet another embodiment, said torques are preferably calculated in function of an error between the desired force $F_{des}$ and the current force F on the user and/or in function of an error between said desired and current movements of the deflection units (35, 36), particularly via a proportional-integral controller, wherein particularly said function is defined by the equations:

$$JF_W=F_{des}+(K_P+K_I/s)(F_{des}-F),$$

$$r'^T F_W=k_T(\Delta x_{T,des}-\Delta x_T)$$

where the matrix J is the 3×4 Jacobian that describes the current geometric relation between rope forces and node force vector, F is current force on the user, and $F_W$ is the vector of winch forces $F_W$ being proportional to said torques u. $K_P$ and $K_I$ are matrices containing proportional and integral gains, respectively, s is the Laplace operator, r' is a vector that describes the geometric relation between rope forces and forces that produce displacement of the deflection units, $\Delta x_T$ is the relative displacement of the deflection units with respect to each other, $\Delta x_{T,des}$ is the desired relative displacement of trolleys, and $k_T$ is a scalar proportional control gain. Regarding controlling it is also referred to the corresponding descriptions above.

It is to be noted that the use of the apparatus as described herein is not limited to medical uses, but may also be employed in any other field of transportation and unloading of objects, particularly in the field of construction.

Figure 5:
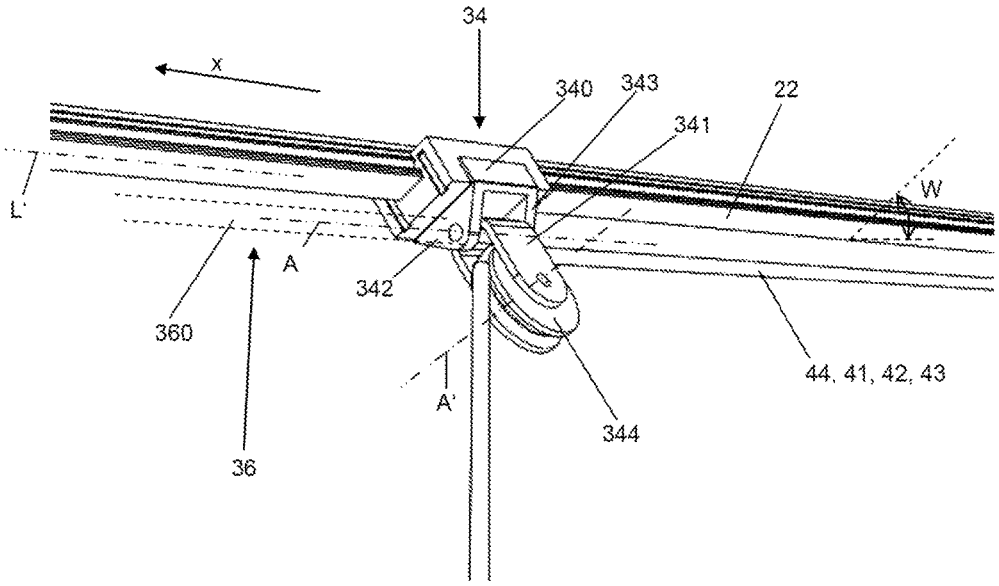
FIG. 5 a perspective view of a deflection device (unit) of the apparatus according to the invention.
Figure 6:
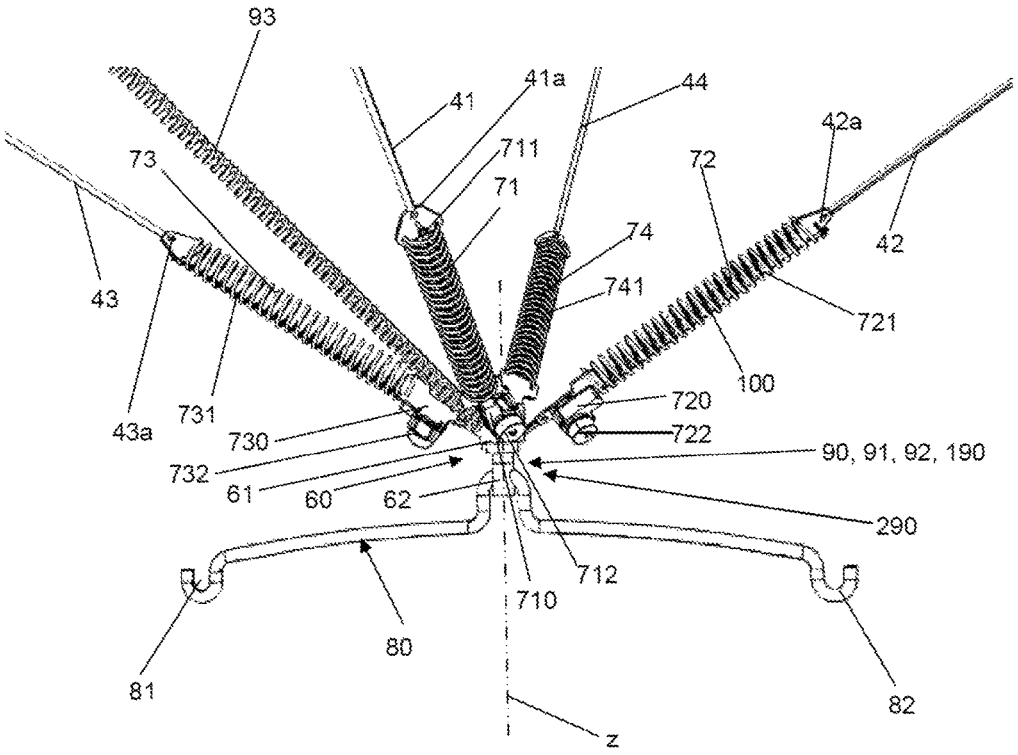
FIG. 6 a closer perspective view of the spring elements, the node, the rope force sensors and the bail of the apparatus according to the invention, FIG. 7 a schematical, perspective view of the apparatus according to the invention when used by a user.
Figure 7:
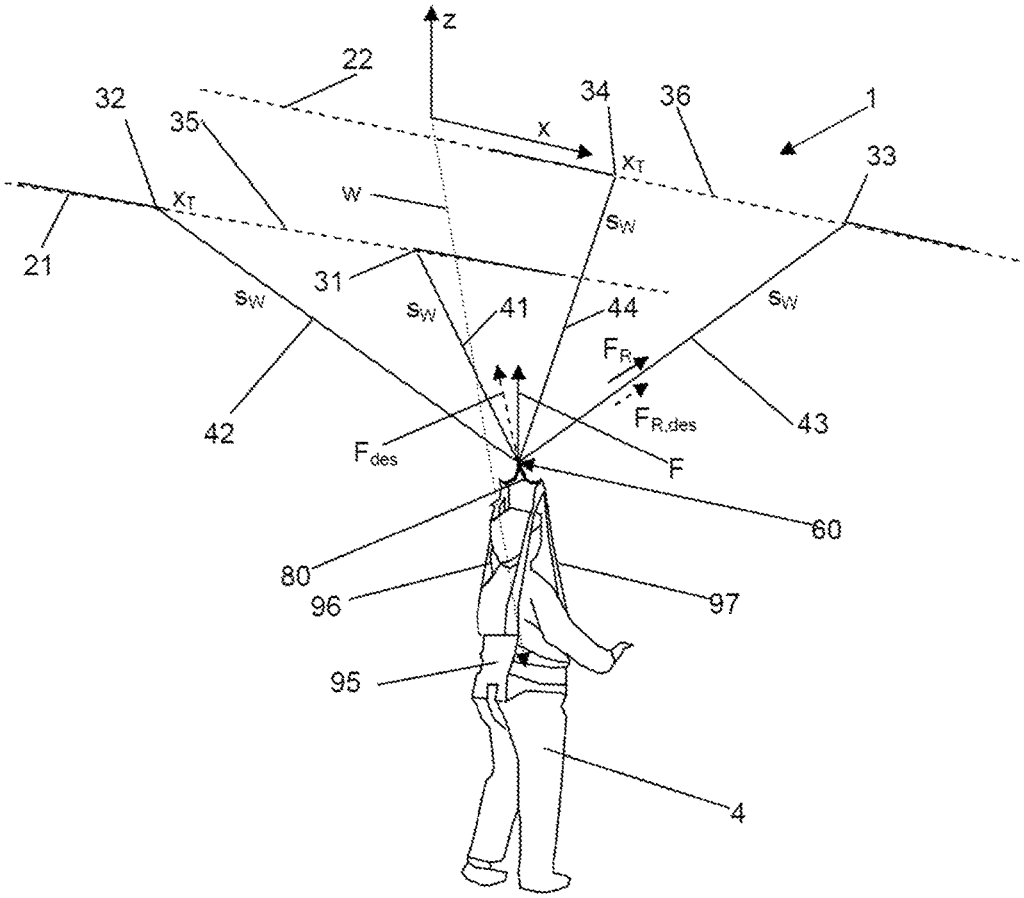

FIG. 1 shows in conjunction with FIGS. 2 to 8 an apparatus 1 according to the invention for guidedly unloading a user 2 upon a physical activity (e.g. gait training as shown in FIG. 7).

The apparatus 1 comprises a suitable support structure (e.g. support frame) 10 having an upper frame part 100 being supported by a plurality of vertically extending leg members 101, such that the leg members 101 confine (together with the upper frame part 100) a three-dimensional working space 3, in which the user 4 can move along the horizontal x-y-plane (as well as vertically in case corresponding objects, e.g. inclined surfaces, staircases etc., are provided in the working space 3). Alternatively, a ceiling of a room can be used as a support structure. Said working space 3 then extends below said ceiling.

The upper frame part 100 is formed by two parallel longitudinal members 102 extending along the x-direction and five parallel cross members 103 extending along the y-direction and connecting the two longitudinal members 102. The longitudinal and cross members 102, 103 span the horizontally extending upper frame part 100.

Figure 2:
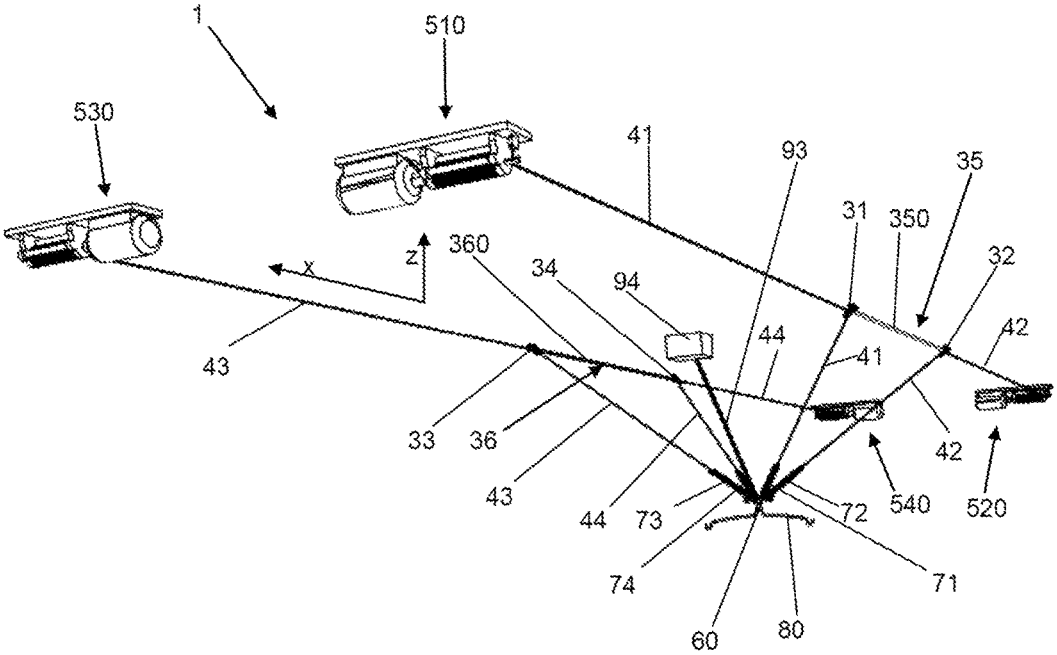
FIG. 2 shows a perspective view of the ropes, drive units, deflection units and the moveable signal processing unit.

A first and a second guiding rail 21, 22 are attached to the support structure 10 (e.g. to the upper frame part 100), wherein the two guide rails 21, 22 each extend along a respective longitudinal axis L, L'. The first guide rail 21 is designed to slidably support a first and a second deflection device 31, 32 as shown in FIG. 2, whereas the second guide rail 22 is designed to slidably support a third and a fourth deflection device 33, 34. Here, the first and the second 31, 32 as well as the third and the fourth deflection device 33, 34 are connected by a rigid connecting means 350, 360 so that the two pairs of deflection devices 31, 32, 33, 34 each form a deflection unit (trolley) 35, 36, which can slide along the respective guide rail 21, 22. Preferably, the guide rails 21, 22 are pivoted by an angle W=45° C. as shown in FIG. 5.

Figure 8:
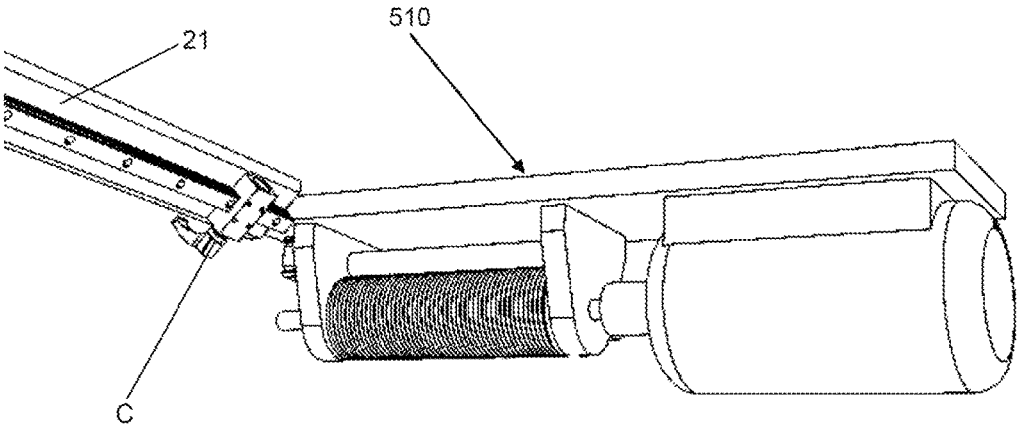
FIG. 8 a schematical perspective view of an arresting means for arresting a deflection device of the apparatus according to the invention.

As indicated in FIG. 8, each deflection device 31, 32, 33, 34 may be arrested with respect to the associated guide rail 21, 22 by means of an arresting element C. Such an element C can be a separate element providing a stop for a deflection device 31, 32, 33, 34 but may also be integrated into a deflection device 31, 32, 33, 34 and may be designed to clamp the respective deflection device 31, 32, 33, 34 to the respective guide rail 21, 22. Particularly, arrested deflection devices 31, 32, 33, 34 may be used when the apparatus 1 is used with a treadmill.

Figure 4:
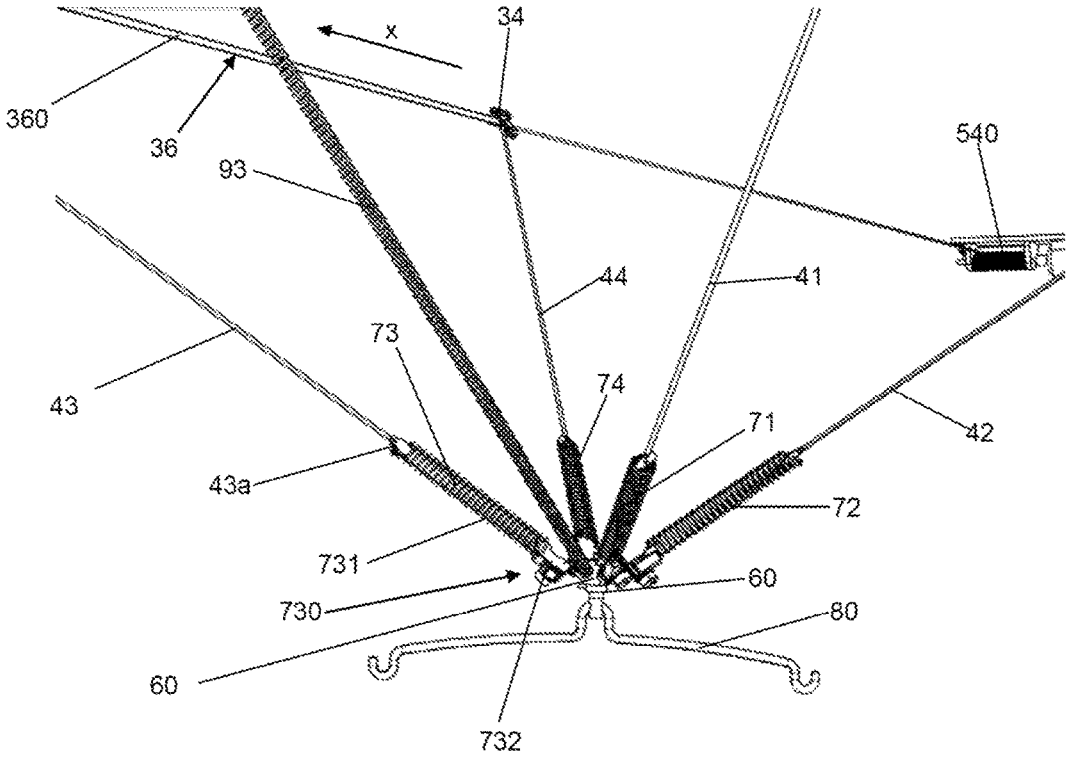
FIG. 4 a perspective view of the spring elements, the rope force sensors, the node and the bail of the apparatus according to the invention.

Each deflection unit 35, 36 is configured to deflect two ropes 41, 42, 43, 44 as shown in FIG. 2, for instance. The individual ropes 41, 42, 43, 44 each extend from a drive unit 510, 520, 530, 540 comprising a winch 511, 521, 531, 541, respectively, on which the respective rope 41, 42, 43, 44 is wound, to an associated deflection device 31, 32, 33, 34 of the respective deflection unit 35, 36. From the deflection devices 31, 32, 33, 34 the ropes 41, 42, 43, 44 extend towards a node 60, to which a first free end of each rope 41, 42, 43, 44 is connected via a spring element 71, 72, 73, 74 as shown in FIGS. 2, 4 and 6 for instance.

The mounting positions D of the individual drive units 510, 520, 530, 540 are indicated in FIG. 1. Each deflection unit 35, 36 is associated to two drive units 510, 520; 530, 540, which are positioned on either side of the respective guide rail 21, 22 along the respective longitudinal axis L, L'.

In FIG. 5 a single deflection device 34 is shown (the others are constructed analogously), wherein the connecting element 360 connecting said device 34 to its neighboring counterpart (not shown) is indicated by dashed lines. The deflection device 34 comprises a base 340 that slidably engages with the respective guide rail 22 so as to allow for sliding the base 340 along the guide rail 22. A u-shaped arm 341 is pivotably hinged to two protruding regions 342, 343 of the base 340 such that the arm 341 can be pivoted about a pivoting axis A running along the x-direction (longitudinal axis L'). The arm 341 serves for bearing a deflection element 344 in the form of a roller being rotatable about a rotation axis A', around which roller 344 the respective rope 44 is laid for deflecting the latter.

Figure 3:
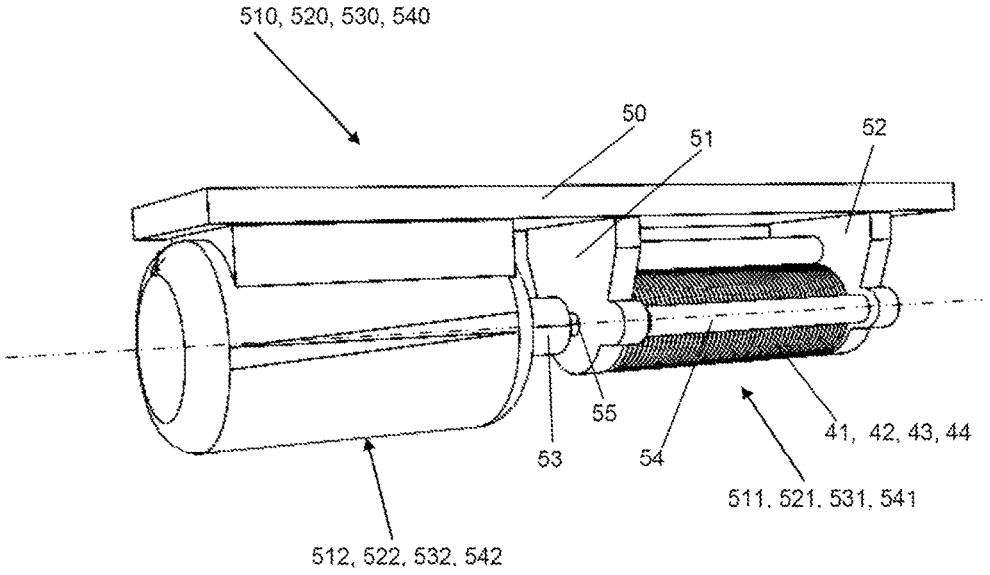
FIG. 3 shows a perspective view of a drive unit according to FIG. 2.

In detail, as shown in FIG. 3, each drive unit 510, 520, 530, 540 comprises an actuator (servo motor) 512, 522, 532, 542 being connected via a (flexible) coupling 53 to a drive axis 55 of a winch 511, 521, 531, 541, on which the respective rope 41, 42, 43, 44 is wound. The respective winch 511, 521, 531, 541 and the respective actuator 512, 522, 532, 542 are mounted on a common platform 50, wherein two retaining elements 51, 52 protrude from the platform 50, on which elements 51, 52 the respective winch 511, 521, 531, 541 is rotatably supported. Further, the respective drive unit 510, 520, 530, 540 comprises at least one pressure roller 54 for pressing the respective rope 41, 42, 43, 44 against the associated winch 511, 521, 531, 541 so that the respective rope 41, 42, 43, 44 can be reeled an unreeled in a defined manner.

The drive units 510, 520, 530, 540 interact with a sensor means (that may consist of several individual sensors, see above) that is adapted to provide output signals that represent (or can be transformed into) the length $s_w$ of (a portion of) the respective rope 41, 42, 43, 44 that is currently unwound from the respective winch 511, 521, 531, 541, the position $s_T$ of the deflection units 35, 36 along the x-direction (i.e. along the respective guide rail 21, 22), as well as the position n of the node 60 (user 4).

As shown in FIG. 6, the ropes 41, 42, 43, 44 meet at the node 60, to which they are coupled via a spring element 71, 72, 73, 74, respectively. In order to be able to detect the rope forces $F_R$ (c.f. FIG. 7) currently acting along the ropes 41, 42, 43, 44 onto the node 60 and thus onto the user 4, four rope force sensors 710, 720, 730, 740 in the form of cable-extension transducers are provided on the node 60, wherein the respective measuring cable 711, 721, 731, 741 of the respective transducer 710, 720, 730, 740 is connected to the first free end 41*a*, 42*a*, 43*a*, 44*a* of the respective rope 41, 42, 43, 44 (either directly or via connection element connecting the respective spring element 71, 72, 73, 74 to the first free end 41*a*, 42*a*, 43*a*, 44*a* of the respective rope 41, 42, 43, 44) while the corresponding potentiometer 712, 722, 732, 742 is coupled to (an upper member of) the node 60. In case a spring element 71, 72, 73, 74 is elongated, the corresponding measuring cable 711, 721, 731, 741 is drawn out and the transducer (potentiometer) 710, 720, 730, 740 generates an output signal corresponding to the drawn-out length of the measuring cable 711, 721, 731, 741 corresponding to the rope force $F_R$ currently acting on the respective rope 41, 42, 43, 44 (and thereby elongating the respective spring element 71, 72, 73, 74). However, any other conceivable force sensor may be applied as well for determining the rope forces. Further, dedicated force sensors in/on the ropes 41, 42, 43, 44 can be omitted. Instead sensors for sensing the electrical current of the winch actuators 512, 522, 532, 542 can be used in order to estimate the respective winch torque. Such a sensor may be associated to each drive unit/winch 510, 520, 530, 540. Further, force sensors 710, 720, 730, 740 may be omitted in case the connecting elements are elastic, since then the rope forces can be determined from the position of the deflection devices 31. 32. 33. 34 along the guide rails 21, 22. Also in the case of non-elastic connections, at least components of the node force may be calculated from the positions of the deflection units (in the example embodiment, the node force component in x direction can be calculated purely based on positions of the trolleys, under the assumption that the trolleys have negligible dynamics such as mass and friction).

Further, the node 60 comprises—with respect to an operating state of the apparatus 1—an upper node member 61, which is connected to the cable-extension transducers 710, 720, 730, 740, and a lower node member 62 being rotatably supported on the upper node member 61, so that a horizontally extending bail 80 being coupled to the lower node member 62 can be rotated about a vertical axis z.

The node 60 may comprise an acceleration sensor 90 as well as a gyroscope 91 and a potentiometer 92 for sensing the acceleration of the node 60 along three orthogonal axes (for instance x, y and z), for sensing the angular velocity of the node 60 and for sensing a rotation angle of the bail 80 about said vertical axis z with respect to the upper node member 61. Further, the node may comprise a magnetometer 190 for sensing orientation of about the three axes. The acceleration sensor 90, the gyroscope 91, and the magnetometer 190 may be integrated into an integrated measuring unit (IMU) 290 providing digital output signals of the respective sensor.

Corresponding output signals representing these quantities (or quantities that can be used to determine the desired quantities) are transmitted—together with the output signals from the rope force sensors 710, 720, 730, 740—via a flexible data line (cable) 93 extending from the node 60 to a movable signal processing unit 94 as shown in FIG. 2. The signal processing unit 94 is slidably supported on one of the guide rails 21, 22.

The signal processing unit 94 can be driven by a further drive unit, wherein preferably the movement of the signal processing unit (also called signal box) 94 is controlled by a controlling unit (not shown), to which the signal processing unit 94 is connected so that the controlling unit is able to use the output signals transmitted by the signal processing unit 94 for controlling of the apparatus 1. Particularly, the controlling unit is configured to control the movement of the signal processing unit 94 such that the distance between the deflection units 35, 36 or node 60 and the signal processing unit 94 along the x-direction is constant. Particularly, the movement of the signal processing unit 94 along the respective guide rail 21, 22 (x-direction) is controlled such by the controlling unit that the signal processing unit is always arranged behind the node 60 (user 4) with respect to the current walking direction of the user 4.

As shown in FIG. 7, the bail 80 is used for holding a harness 95 which is to be put on by the user 4. The harness 95 then supports the user 4 via two connection elements 96, 97 that are engaged with corresponding receptacles 81, 82 formed on the free ends of the bail 80, and via the node 60 to which the bail 80 is coupled.

Concerning control of the current resulting force F that is exerted onto the node 60, there are many ways in classical control theory how to approach tracking problems for non-linear systems as the present one. For example, the system could be linearized and an optimal controller could be derived. In the following, controlling is described without loss of generality for four ropes, but may also be conducted analogously for two ropes or any larger number of ropes.

One idea is to control said output force vector F indirectly, by controlling individual rope forces subsumed in the vector $F_R \in \mathbb{R}^4$ in an inner loop. These rope forces $F_R$ are functions of both the device states s, i.e., the lengths $s_W$ of the unwound (portions of the) ropes 41, 42, 43, 44 (note, that the individual $s_W$ of the ropes 41, 42, 43, 44 shown in FIG. 7 may well be different from one another) and the deflection unit's 35, 36 positions $x_T$, and the user position w:

$$F_R = h(s,w)$$

The three-dimensional force vector F acting on the subject 4 is given by the sum of the four individual rope force vectors $F_R$. Therefore, there would potentially be an infinite number of solutions for rope force vectors that give the same resulting force.

However, as stated above, the winch forces (torques) do not only affect rope forces, they also affect trolley (deflection unit) movement.

This can be used to formulate two additional control goals, which are a) to find a solution that is also valid in static conditions (Then, the sum of forces acting on the trolleys 35, 36 will be in equilibrium, and the position can be held), and b) to have the trolleys 35, 36 move in a similar way, so that they are always at the same position x (c.f. FIG. 7). For example, if a purely vertical force is desired and the person 4 is standing in the middle between the two linear guide rails 21, 22, the trolleys 35, 36 should be positioned such that the person 4 stands below the center of a square spanned by the pulleys (deflection devices) 31, 32, 33, 34.

The first goal can be formulated mathematically by requiring that in static conditions, where all speeds and accelerations are zero, $$ds_W/dt=0, d^2s_W/dt^2=0, dx_T/dt=0, d^2x_T/dt^2=0, dw/dt=0, d^2w/dt^2=0,$$

the correct force is applied on the user (object) 4, i.e. the current resulting force (output force) F of the controlling unit (controller) matches the desired resulting force $F_{des}$ meaning equation $F=F_{des}$ is fulfilled. The requirement is found by force equilibrium on the two trolleys 35, 36.

In summary, this yields 3 equations from force equilibrium on the node 60, further 2 equations from force equilibrium on the two trolleys 35, 36 in x-direction, and one equation commanding the two trolleys 35, 36 to be at the same position $x_T$ in x-direction. These 6 equations can be used to find the four desired rope forces $F_{R,des}$ and the two trolley positions.

Appropriate measures (for example saturations) can be taken to make sure the ropes 41, 42, 43, 44 always remain in tension.

The desired rope forces $F_R$ can then be used as a reference for the individual feedback loops for each winch 511, 521, 531, 541.

For example, the control law could be $$u=i(F_{R,des}+K_r(F_{R,des}-F_R))+u_{ff},$$

with $F_{R,des}$ being the calculated desired (reference) rope forces, i the transmission ratio of the actuator-winch unit (drive unit) 510, 520, 530, 540, $K_r\in\mathbb{R}^{4\times4}$ being a positive definite rope force feedback matrix containing feedback gains, and $u_{ff}$ denoting potential additional terms that go to zero in static conditions. The first two terms will ensure that the system asymptotically approaches the desired forces on the person 4, at least when the person 4 stands still.

In order to make the system react fast in dynamic conditions, the terms $u_{ff}$ can be used. One possibility is to use a type of "synergy control", where actuators 512, 522 532, 542 work in groups. For example, using a diagonal feedback matrix $K_C\in\mathbb{R}^{3\times3}$, a virtual input vector u* in Cartesian space can be generated:

$$u^*=K_C(F_{des}-F)\in\mathbb{R}^3$$

This three-dimensional vector u* then needs to be mapped to the four winch torques u by a function ρ:

$$u=\rho(u^*).$$

Similar to human muscles, this function could encode synergies, which lump actuators 512, 522, 532, 542 into functional groups.

For example, if the force component acting on the user 4 in vertical direction z is too low compared to the reference, so $u^*_z>0$, all four winches 511, 521, 532, 541 could be pulling equally, which means that the vertical component $u^*_z$ would simply be commanded to all winches 511, 521, 532, 541 equally. The component in x-direction, which is parallel to the guide rails 21, 22, could be distributed such that the winches on one side (depending on the sign, these could be 511 and 531, cf. FIG. 2) act as a pair and both pull equally, whereas the opposite pair 521, 541 does not produce additional torques. Necessary corrections in the direction orthogonal to the guide rails 21, 22 could be distributed in an analog manner, with either the winch pair 511, 521 or 531, 541 pulling, depending on the sign. This type of control law leads to a fast correction of the forces acting on the user (object) 4, and it also accelerates the movement of the passive trolleys 35, 36 towards their "ideal" asymptotic positions. In static conditions, this part of the controller will not generate any torques u.

Figure 9:
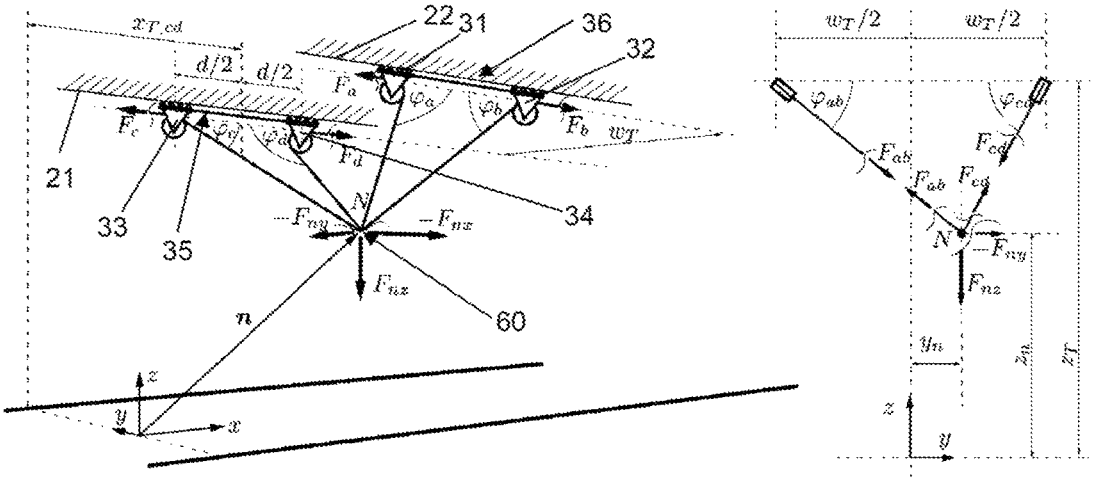
FIG. 9 another perspective view of an apparatus according to the invention.

According to another embodiment illustrated in FIG. 9 In the chosen right-handed Cartesian coordinate system, z points upward and x points forward in the default gait direction, parallel to the guide rails 21, 22. As the joints in the node 60 ensure that only forces are transmitted, the harness can be represented by a single cable that connects the node to a specific point $w=(w_x,w_y,w_z)^T$ on the human (cf. FIG. 7).

A state vector is assembled that describes the current positions and velocities of the device components. Given the current position vector w of the human, the configuration is fully described by be the length of ropes that have been released from each winch 511, 521, 531, 541 subsumed in the vector $s_W\in\mathbb{R}^4$:

$$s_W=(s_a s_b s_c s_d)^T, \tag{1}$$

and by the positions of the deflection units 35, 36, subsumed in the vector $x_T\in\mathbb{R}^2$:

$$x_T=(x_{T,ab} x_{T,cd})^T. \tag{2}$$

The state vector $s\in\mathbb{R}^{12}$ contains these variables and their derivatives:

$$s=(s_W^T x_T^T \dot{s}_W^T \dot{x}_T^T)^T \tag{3}$$

We now assume that the force vector $F_n$ on the user ("n" stand for the node; the force vector is also denoted shortly F) acting on the user 4 is to be controlled while the user moves. Node position is $n=(n_x,n_y,n_z)^T$. Cable (i.e. rope) forces are subsumed in the vector $F_r\in\mathbb{R}_+$ (note, that the rope forces are also denoted as $F_R$) with $$F_r=(F_a F_b F_c F_d)^T \tag{4}$$

and the Cartesian force vector $F_n\in\mathbb{R}^3$ on the user 4 is $$F_n=(F_{nx} F_{ny} F_{nz})^T \tag{5}$$

Force equilibrium on the node 60 maps cable forces to forces $F_n$ acting on the user 4:

$$F_n=J(x_T,n)F_r. \tag{6}$$

The mapping J can be computed in an efficient way by first summing the rope forces within the two planes spanned by the ropes, via the matrix R, to obtain the x component and the force components $F_{ab}$ and $F_{cd}$, and then converting these to Cartesian space via the matrix S:

$$J=\begin{pmatrix}1 & 0\\ 0 & S\end{pmatrix}R \tag{7}$$

with $$S=\begin{pmatrix}-\cos\varphi_{ab} & \cos\varphi_{cd}\\ \sin\varphi_{ab} & \sin\varphi_{cd}\end{pmatrix}, \tag{8}$$

$$R=\begin{pmatrix}\cos\varphi_a & -\cos\varphi_b & \cos\varphi_c & -\cos\varphi_d\\ \sin\varphi_a & \sin\varphi_b & 0 & 0\\ 0 & 0 & \sin\varphi_c & \sin\varphi_d\end{pmatrix}. \tag{9}$$

Current deflection unit 35, 36 positions $x_T$ and the node position n define the angles in these matrices.

The movement of the deflection units 35, 36 is governed by the equations of motion:

$$m_T\ddot{x}_T=TF_r \tag{10}$$

with $$T=\begin{pmatrix}\cos\varphi_a-1 & 1-\cos\varphi_b\\ \cos\varphi_c-1 & 1-\cos\varphi_d\end{pmatrix} \tag{11}$$

The equations of motion for the winches 511, 521, 531, 541 are given by:

$$m_W\ddot{s}_W=F_r-F_W, \tag{12}$$

with the winch actuator forces $F_W$ (e.g. the torques multiplied by a transmission ratio i). The rope forces are a linear function of the spring deflections of the springs 71, 72, 73, 74 (cf. FIG. 6):

$$F_r=c_F(-s_W+Gx_T-l) \tag{13}$$

with the matrix $$G=\begin{pmatrix} 1 & 0 \\ -1 & 0 \\ 0 & 1 \\ 0 & -1 \end{pmatrix} \tag{14}$$

and the vector l containing the distances from the four deflection devices 31, 32, 33, 34 to the node 60 (vector n). To avoid offsets in these equations, the rope lengths $s_W$ are defined appropriately.

Even without force sensors, it is still possible to implicitly measure the force in x direction, by means of deflection device 31, 32, 33, 34 positions. Assuming that the mass of the deflection devices 31, 32, 33, 34 is negligible, their positions are determined by the components of the cable forces acting in x direction: Static equilibrium on the deflection device 31, 32, 33, 34 is given by setting (10) to zero. Combined with (6), the force in x direction is then given by:

$$F_{nx}=F_{ab}\frac{\cos\varphi_b-\cos\varphi_a}{\sin\varphi_a-\sin(\varphi_a+\varphi_b)+\sin\varphi_b}+F_{cb}\frac{\cos\varphi_d-\cos\varphi_c}{\sin\varphi_c-\sin(\varphi_c+\varphi_d)+\sin\varphi_d} \tag{15}$$

These angles are calculated based on geometry only (rope lengths, deflection device positions). To keep the estimation robust, $F_{ab}$ and $F_{cd}$ are taken preferably as the desired, not the actual values, even if force sensors are available.

Now, an ideal controller would command actuator torques u, so that the outputs match the desired force vector $F_{n,des}$ that acts on the subject (also denoted as user) 4:

$$F_n \overset{!}{=} F_{n,des}, \tag{16}$$

regardless of the movement of the subject 4. Preferably, a force controller (provided by the controlling unit) is used in Cartesian space, which commands a Cartesian force vector ${}^{C}F_{fc}$ that is to be realized by the winches. This force is calculated by PI (proportional-intergral) control and feed-forward of the reference:

$${}^{C}F_{fc}=F_{n,des}+\left(K_P+\frac{K_I}{s}\right)(F_{n,des}-F_n), \tag{17}$$

with s being the Laplace operator, $K_P$ being a positive definite matrix of proportional gains, and $K_I$ being a positive definite matrix of integral gains.

Cartesian forces need to be mapped to winch forces $F_w$, which is the inverse problem of (6). Given that there are four winch forces and only three node force components, there are multiple solutions to (6) with a given node force. If the deflection devices 31, 32, 33, 34 were not movable, quadratic programming could be used to find the minimal cable forces that fulfill the constraints. However, in the current system, the rope forces do not only influence the output force vector, but they also influence the movement of the deflection devices 31, 32, 33, 34, according to (10). In turn, the position of the deflection devices 31, 32, 33, 34 defines the polygon of applicable forces.

Therefore, instead of minimizing rope forces, one may take deflection device dynamics into account to solve the rank deficiency in the inverse mapping of (6). The idea is that rope forces are applied in such a way that the deflection devices 31, 32, 32, 34 stay together, leading to a polygon with rectangular base. This behavior is enforced by the law:

$$m_T(\ddot{x}_{T,ab}-\ddot{x}_{T,cd}) \overset{!}{=} -k_T(x_{T,ab}-x_{T,cd}) \tag{18}$$

with the positive constant $k_T$.

With (10), this yields $$F_a(1-\cos\varphi_a)-F_b(1-\cos\varphi_b)-F_c(1-\cos\varphi_c)+F_d(1-\cos\varphi_d) \overset{!}{=} k_T(x_{T,ab}-x_{T,cd}) \tag{19}$$

Using this additional constraint on the forces, the control law maps desired forces in Cartesian space to winch forces, such that they work in synergy:

$$F_w=R'^{-1}\begin{pmatrix} \begin{pmatrix} 1 & 0 \\ 0 & S^{-1} \end{pmatrix}{}^{C}F_{fc} \\ k_T(x_{T,ab}-x_{T,cd}) \end{pmatrix} \tag{20}$$

with the desired reference force in Cartesian space $F_{n,des}$ and the modified mapping matrix $$R'=\begin{pmatrix} R \\ r'^T \end{pmatrix}, \tag{21}$$

With $$r'^T=(1-\cos\varphi_a\ \cos\varphi_b-1\ \cos\varphi_c-1\ 1-\cos\varphi_d). \tag{22}$$

In the above, one may calculate the force in x direction as a linear combination (for example the mean value) of spring-based measurement and deflection device-based measurement.

We claim:

1. An apparatus for unloading a user's body weight during a physical activity of the user or for unloading an object, comprising:

a rope;

a deflection device;

a drive unit;

a node;

a horizontal guide rail;

a force sensor configured to determine a force on the rope;

a winch;

an actuator; and a sensor configured to detect a length of the rope that is free of the winch and a position of the deflection device on the horizontal guide rail as indicators of a position of the node and, subsequently, the user or the object, wherein the rope extends at one end from the drive unit to the deflection device, and is deflected by the deflection device, wherein the rope is coupled to the node, wherein the deflection device is slidably connected to the horizontal guide rail and is configured to be displaced by forces induced into the deflection device via the rope, wherein the node is configured to be coupled to the user or the object, wherein the drive unit is configured to retract and release the rope to adjust the force along the rope, wherein the rope is connected at its first end to the winch and is configured to be wound around the winch, wherein the actuator is configured to exert a torque on the winch which effects winding of the rope around the winch, and wherein the apparatus is configured to unload a portion of the user's body weight or of the object's weight and to support the user or the object.

2. The apparatus according to claim 1, further comprising:

a second rope, a third rope, and a fourth rope;

a second deflection device, a third deflection device, and a fourth deflection device; and a second drive unit, a third drive unit, and a fourth drive unit, wherein the second rope extends at one end from the second drive units to the second deflection device, and is deflected by the second deflection device, wherein the third rope extends at one end from the third drive unit to the third deflection device, and is deflected by the third deflection device, wherein the fourth rope extends at one end from the fourth drive unit to the fourth deflection device, and is deflected by the fourth deflection device, wherein each of the second, third and fourth ropes are coupled to the node, and wherein each of the second, third and fourth drive units are configured to retract and release the second, third and fourth ropes, respectively to adjust a force along the second, third and fourth ropes, respectively.

3. The apparatus according to claim 2, further comprising a second horizontal guide rail.

4. The apparatus according to claim 3, wherein the deflection device and the second deflection device are slidably connected to the horizontal guide rail and the third deflection device and the fourth deflection device are slidably connected to the second horizontal guide rail.

5. The apparatus according to claim 4, wherein the deflection device and the second deflection device each comprise a base slidably connected to the horizontal guide rail, wherein the third deflection device and the fourth deflection device each comprise a base slidably coupled to the second horizontal guide rail, and wherein the deflection device and the second deflection device each comprise a respective arm hinged to the respective base of the deflection device and the second deflection device, so that the respective arm is pivotable relative to the respective base about a pivot axis running parallel to a longitudinal axis of the horizontal guide rail, and wherein the third deflection device and the fourth deflection device each comprise a respective arm hinged to the respective base of the third deflection device and the fourth deflection device, so that the respective arm is pivotable relative to the respective base about a pivot axis running parallel to a longitudinal axis of the second horizontal guide rail, and wherein the deflection device, the second deflection device, the third deflection device and the fourth deflection device each comprise a respective roller connected to the respective arm, around which the rope, the second rope, the third rope and the fourth rope is laid.

6. The apparatus according to claim 3, wherein each of the horizontal guide rail and the second horizontal guide rail are configured to be connected to a support structure, and wherein the horizontal guide rail and the second horizontal guide rail run parallel to each other, wherein the horizontal guide rail and the second horizontal guide rail are tilted relative to a horizontal, about a longitudinal axis.

7. The apparatus according to claim 1, wherein the apparatus comprises a control unit configured to control the drive unit such that when the force on the rope approaches a desired force the position of the node is adjusted.

8. The apparatus according to claim 7, wherein the control unit is configured to control a torque exerted by the actuator onto the winch such that when the force on the node and, subsequently, the user or the object approaches a desired force, the control unit is configured to control movement of the deflection unit.

9. The apparatus according to claim 7, wherein the drive unit comprises a brake for arresting the winch, and wherein the drive unit comprises a presser configured to press the rope against the winch.

10. The apparatus according to claim 1, wherein the force sensor interacts with the rope to determine the force on the rope.

11. The apparatus according to claim 10, wherein the force sensor is connected to the node, wherein the rope is connected to the node via a spring, wherein the force sensor is configured to measure a length of the spring, wherein the force sensor comprises a cable-extension transducer having a measuring cable wound on a cylinder coupled to a shaft of a rotational sensor, and wherein the measuring cable is connected to the rope and the spring.

12. The apparatus according to claim 1, further comprising:

a second rope;

a second deflection device; and a second drive unit, wherein the second rope extends at one end from the second drive unit to the second deflection device, and is deflected by the second deflection device, wherein the second rope is coupled to the node, and wherein the second drive unit is configured to retract and release the second rope to adjust forces along the rope.

13. The apparatus according to claim 1, wherein the deflection device is configured to be suspended from a support frame or from a ceiling of a room.

14. The apparatus according to claim 1, further comprising a bail for coupling the node to the user or to the object, wherein the bail is rotatably connected to the node, so that the bail is rotatable about a vertical axis, wherein the bail comprises two opposing free ends, wherein each of the two opposing free ends comprises a receptacle for receiving a connector for connecting a harness to the bail, wherein the harness is designed to be attached to the user or to the object in order to connect the user or the object to the node via the bail, and wherein the connectors are configured to be length adjustable for adapting the apparatus to the user or the object.

15. An apparatus for unloading a user's body weight during a physical activity or for unloading an object's weight, comprising:

a plurality of ropes, a plurality of drive units and a plurality of deflection devices, wherein each of the plurality of ropes extend from a respective drive unit of the plurality of drive units to a respective deflection device of the plurality of deflection devices and is deflected by the latter, wherein each of the plurality of deflection devices is designed to be displaced by forces induced into the respective deflection device via the respective rope, and a node being coupled to each of said plurality of ropes and being designed to be coupled to the user or the object, wherein each of the plurality of drive units are designed to retract and release the respective rope so as to adjust a current rope force along the respective rope, wherein said current rope forces along said plurality of ropes add up to a current resulting force exerted on said user or said object via said node in order to unload the user or the object and/or to exert a force on the user or the object in a horizontal plane.

16. A method for controlling an apparatus for unloading a body weight of a user or an object, comprising the steps of:

calculating torques for a plurality of winches, exerting the torques onto the plurality of winches in order to adjust current rope forces acting along a plurality of ropes coupled to the plurality of winches, respectively, wherein each rope of the plurality of ropes is connected to a single node, wherein the user was coupled in to said node beforehand such that said rope forces acting along said plurality of ropes add up to a current resulting force acting on the user or the object via the node, and wherein each of the ropes is respectively deflected by a respective deflection device of a plurality of deflection devices, the respective deflection device being displaceable by forces induced into the respective deflection devices via a respective rope, and wherein the torques are calculated such that a position of the node approaches a desired position of the node or that said current resulting force on the user or on the object approaches a desired force on the user and/or such that the deflection devices approach desired movements, respectively, when the calculated torques are exerted onto the plurality of winches.

* * * * *